US007311154B2

(12) United States Patent
Cho et al.

(10) Patent No.: US 7,311,154 B2
(45) Date of Patent: Dec. 25, 2007

(54) LINE SLACK COMPENSATOR

(75) Inventors: Brian W. Cho, Sugar Land, TX (US); Sara Escanero Ereza, Houston, TX (US); Dinesh R. Patel, Sugar Land, TX (US); Malcolm J. Carr, Loch Carron (GB)

(73) Assignee: Schlumberger Technology Corporation, Rosharon, TX (US)

( * ) Notice: Subject to any disclaimer, the term of this patent is extended or adjusted under 35 U.S.C. 154(b) by 314 days.

(21) Appl. No.: 10/906,157

(22) Filed: Feb. 4, 2005

(65) Prior Publication Data

US 2006/0000618 A1 Jan. 5, 2006

Related U.S. Application Data

(60) Provisional application No. 60/521,767, filed on Jul. 1, 2004.

(51) Int. Cl.
*E21B 23/00* (2006.01)

(52) U.S. Cl. ..... 166/381; 166/241.1

(58) Field of Classification Search ..... None
See application file for complete search history.

(56) References Cited

U.S. PATENT DOCUMENTS

| | | | | |
|---|---|---|---|---|
| 2,744,420 | A * | 5/1956 | Pigford | 74/501.5 R |
| 3,593,508 | A * | 7/1971 | Jachimowicz et al. | 57/114 |
| 4,543,998 | A * | 10/1985 | Thomerson | 138/110 |

FOREIGN PATENT DOCUMENTS

| | | | |
|---|---|---|---|
| JP | 58144068 | A | 8/1983 |
| JP | 08002833 | A | 1/1996 |
| SU | 474604 | A1 | 6/1975 |
| SU | 1155735 | A1 | 5/1985 |

* cited by examiner

*Primary Examiner*—Frank Tsay
(74) *Attorney, Agent, or Firm*—Bryan P. Galloway; Dona C. Edwards; Robert A. VanSomeren

(57) ABSTRACT

A completion assembly has one or more control lines. The control lines can develop differing degrees of slack depending on the completion assembly configuration and also on the particular use of the completion assembly. A line slack compensator cooperates with the completion assembly to provide or remove slack in one or more control lines as necessary for a given operation and a given completion assembly.

28 Claims, 7 Drawing Sheets

LINE SLACK COMPENSATOR

This application claims the benefit of U.S. Provisional Application 60/521,767 filed on Jul. 1, 2004.

BACKGROUND

1. Field of Invention

The present invention pertains to a downhole completion assembly having at least one control line, and particularly to a completion assembly in which the at least one control line has at least one splice.

2. Related Art

It is often desirable to run one or more control lines in, on, or through assemblies to be placed in a well. Control lines include, but are not limited to, hydraulic conduits, electrical line conduits, and fiber optic cables. A control line is generally used to communicate in some manner with one or more tools placed in the well. For example, a packer placed downhole may be set by hydraulic fluid pressure communicated from the surface to an actuator mechanism of the packer. Alternatively, a fiber optic cable may be pumped through a control line and used, for example, to measure the temperature profile of the well, or communicate a command to a tool downhole.

Control lines can be comprised of two or more segments. Those segments are typically (but not always) joined at the surface. Using segments may require the control line to have one or more splice. Once assembled, the control line is typically attached to the tubular or completion assembly being run into the well and the combined tubular or completion assembly and control line are run in the well together.

SUMMARY

The present invention provides for a completion assembly having a line slack compensator to provide or remove slack in a control line.

Advantages and other features of the invention will become apparent from the following description, drawings, and claims.

DETAILED DESCRIPTION

Figure 1:
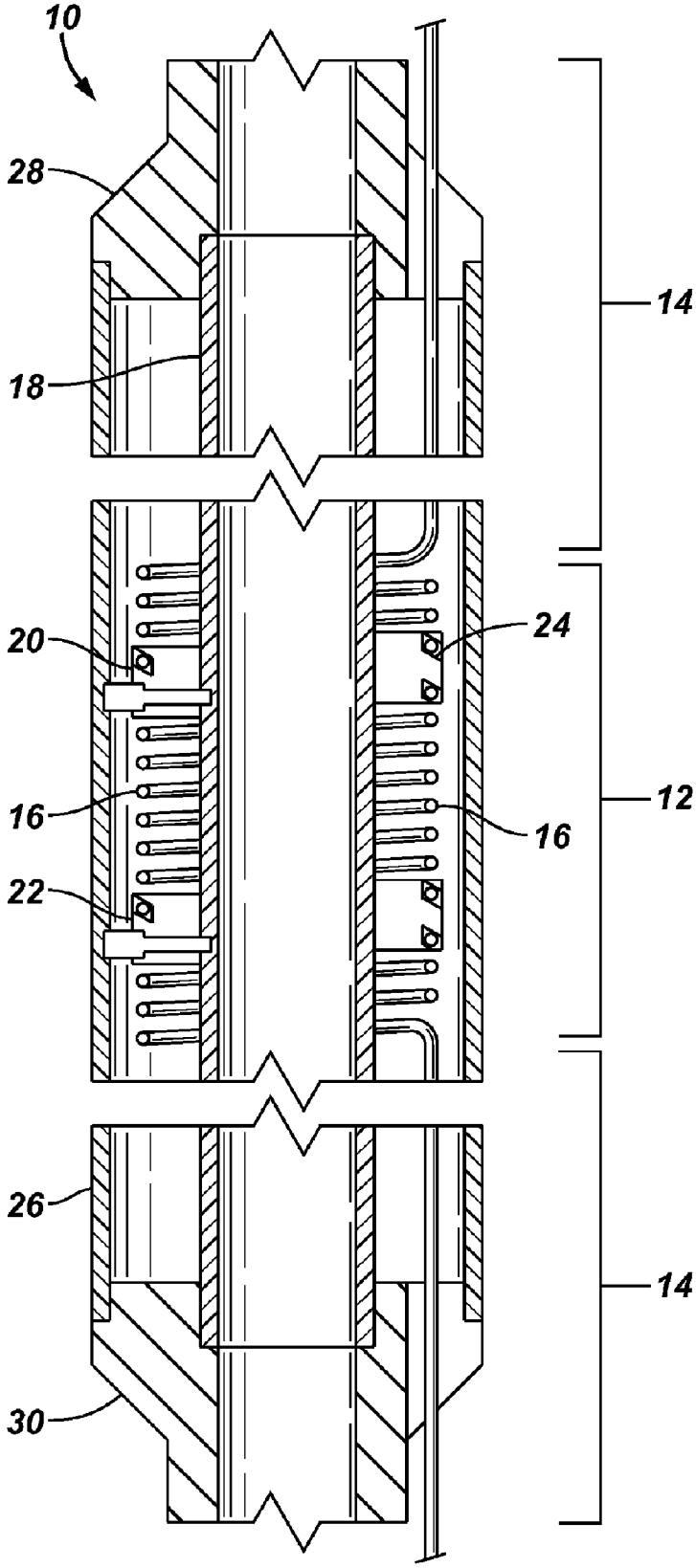
FIG. 1 is a schematic view illustrating a line slack compensator constructed in accordance with the present invention.

Referring to FIG. 1, a line slack compensator 10 comprises a coiled control line section 12 and a straight control line section 14. Control line sections 12, 14 include, but are not limited to, hydraulic conduits, electrical line conduits, and fiber optic cables conduits. Fiber optic cable conduits include conduits having one or more fiber optic strands pumped therethrough or pre-packaged fiber optic strands housed in a self-contained protective covering. Straight control line section 14 can be above or below coiled control line section 12, or both. Coiled control line section 12 comprises coils 16 that can expand or contract to allow or take up slack, as desired.

Coiled control line section 12 is carried on a mandrel 18. An upper slider sleeve 20 or a lower slider sleeve 22, or both, are also carried on mandrel 18 and engage coils 16 with slots 24. Mandrel 18 may have threads on its outer surface complementary to threads on the inner surfaces of sleeves 20, 22 so sleeves 20, 22 can be axially displaced along mandrel 18 when sleeves 20, 22 are rotated relative to mandrel 18. Alternatively, the outer surface of mandrel 18 and the inner surface of sleeves 20, 22 may be smooth to allow sliding displacement of sleeves 20, 22 along mandrel 18. A protective sleeve 26 covers at least coiled control line section 12 and protects it from damage. Slider sleeves 20, 22 can be releasably fixed to mandrel 18, for example, by set screws. Those set screws or other fixing means are accessed through openings in protective sleeve 26. Guide lines may be provided to assist alignment.

A possible assembly method includes attaching mandrel 18 to a top sub 28. Upper slider sleeve 20 is installed on mandrel 18. Coiled control line section 12 is placed on mandrel 18 and upper slider sleeve 20 is spun down to engage coils 16. Preferably a few turns of coils 16 are positioned above upper slider sleeve 20. The upper portion of straight control line section 14 is joined to the upper portion of coiled control line 12 to allow fluid communication therethrough.

Lower slider sleeve 22 is installed on mandrel 18 and spun onto coiled control line 12 with slots 24 engaging coils 16. Preferably a few turns of coils 16 are positioned below lower slider sleeve 22. Protective sleeve 26 is mounted over coiled control line section 12 and slider sleeves 20, 22, for example, by joining it to top sub 28. Set screws, locking bolts, or other fixing means are passed through openings in protective sleeve 26 and releasably secure slider sleeves 20, 22 to mandrel 18. The lower portion of straight control line 14 is joined to the lower portion of coiled control line 12 to allow fluid communication therethrough. A bottom sub 30 may be joined to the lower end of mandrel 18.

In operation, say to provide slack at the lower end of line slack compensator 10, the set screws (fixing means) holding lower slider sleeve 22 to mandrel 18 are loosened sufficiently to allow lower slider sleeve 22 to be moved downward. As lower slider sleeve 22 moves downward, coils 16 are stretched, producing slack at the lower end of line slack compensator 10. To remove the slack, lower slider sleeve 22 is displaced upward to compress coils 16. The extra coils below lower slider sleeve 22 compensate if the full slack provided is not all returned. Slack at the upper end of line slack compensator 10 is achieved in the same manner using upper slider sleeve 20.

Figure 2A:
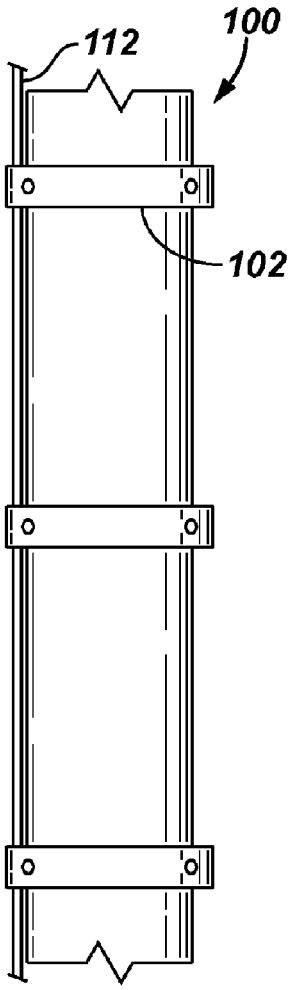
FIGS. 2A-2C is a schematic view illustrating an alternate embodiment of a line slack compensator constructed in accordance with the present invention.
Figure 2B:
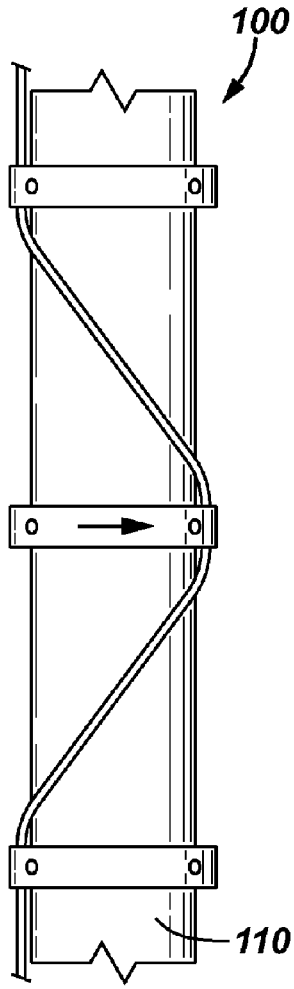
Figure 2C:
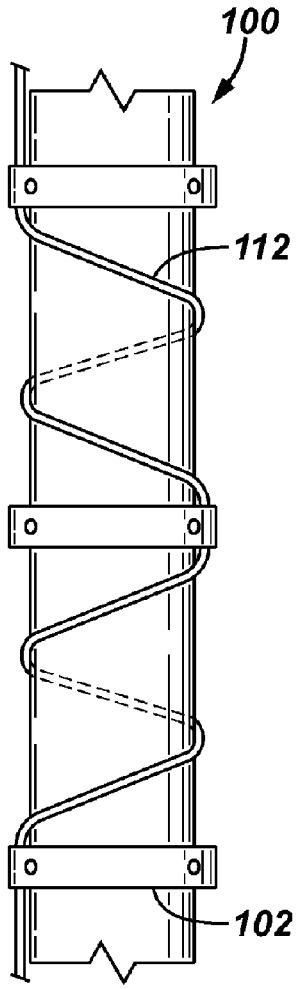

An alternate embodiment of a line slack compensator 100 is shown in FIGS. 2A-2C. In this embodiment, rings 102 are used to provide or remove slack. Preferably three rings 102 are used, but the invention may have more or fewer rings 102, as desired. For ease of discussion, an embodiment using three rings 102 is discussed below.

Figure 3:
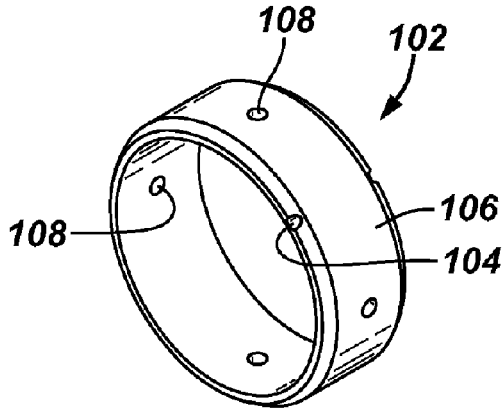
FIG. 3 is a perspective view of a ring used in the embodiment of the line slack compensator of FIGS. 2A-2C.

In the embodiment shown, each ring 102 has at least one longitudinal or axially-directed hole 104 running through the sidewall 106 of ring 102, as shown in FIG. 3. Hole 104 may have some curvature as it passes through sidewall 106. Ring 102 also has at least one radially-directed hole 108 through sidewall 106. Rings 102 are carried on a mandrel 110. Upper and lower rings 102 are fixed to mandrel 110 with holes 104 aligned. Middle ring 102 is free to rotate on mandrel 110. Hole 108 can be used to allow access to mandrel 118 to releasably secure ring 102 to mandrel 110. For example, hole 108 may have threads to receive a set screw.

Control line 112 is fed through holes 104. When holes 104 of each ring 102 are aligned, slack is provided. While slack is provided, splicing operations may be performed with control line 112. To remove slack, middle ring 102 is turned in either direction, wrapping control line 112 around mandrel 110. Once the desired amount of slack is removed, middle ring 102 can be fixed to mandrel 110. Using more rings 102 will permit management of larger amounts of slack in control line 112.

Figure 5A:
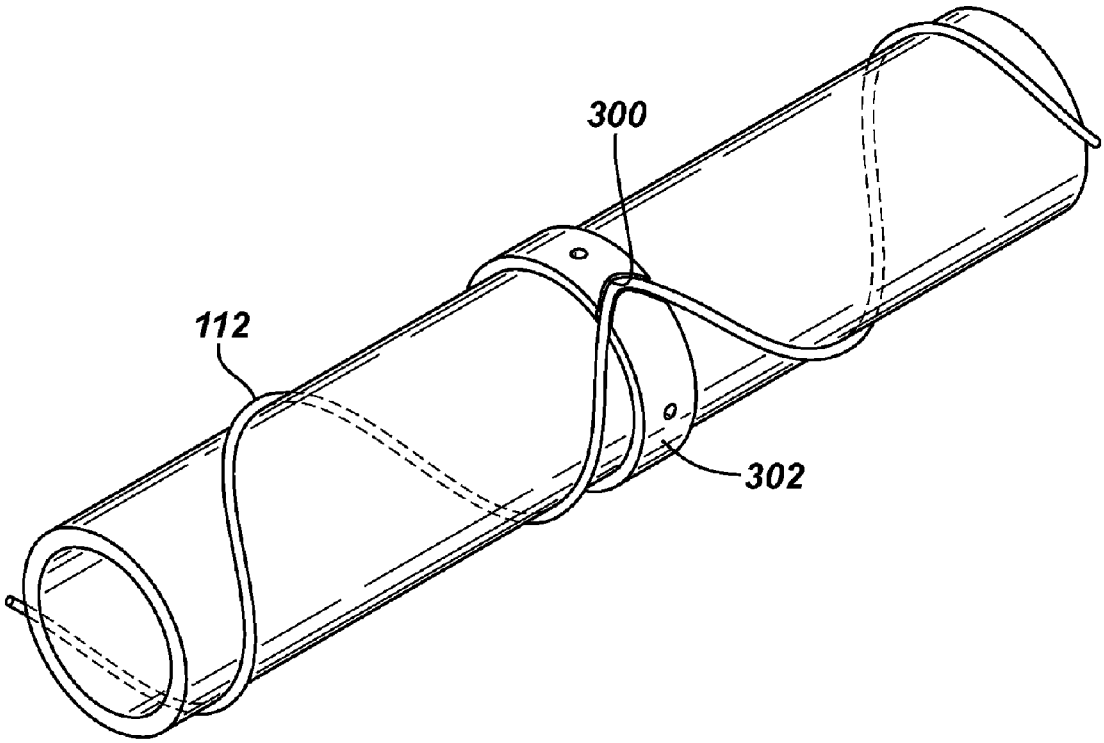
FIG. 5A is a schematic view of a line slack compensator constructed in accordance with the present invention.
Figure 5B:
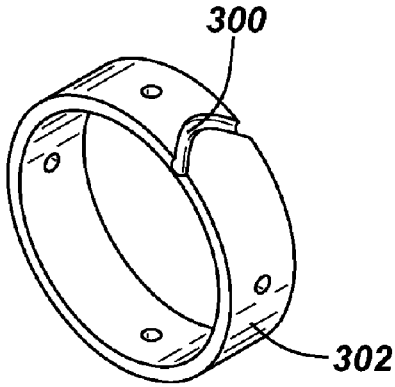
FIG. 5B is a schematic view of a component of the line slack compensator of FIG. 5A.

Although rings 102 are described as having holes 104 therethrough, control line 112 can also be clamped or otherwise secured to ring 102 so as to rotate with ring 102. For example, the embodiment of line slack compensator 10 shown in FIG. 5A has a curved groove 300 on ring 302 in which control line 112 is carried. FIG. 5B shows an enlarged view of ring 302 and groove 300. If desired, a strap could be placed over control line 112 once placed in groove 300 to protect and restrain control line 112.

Figure 6A:
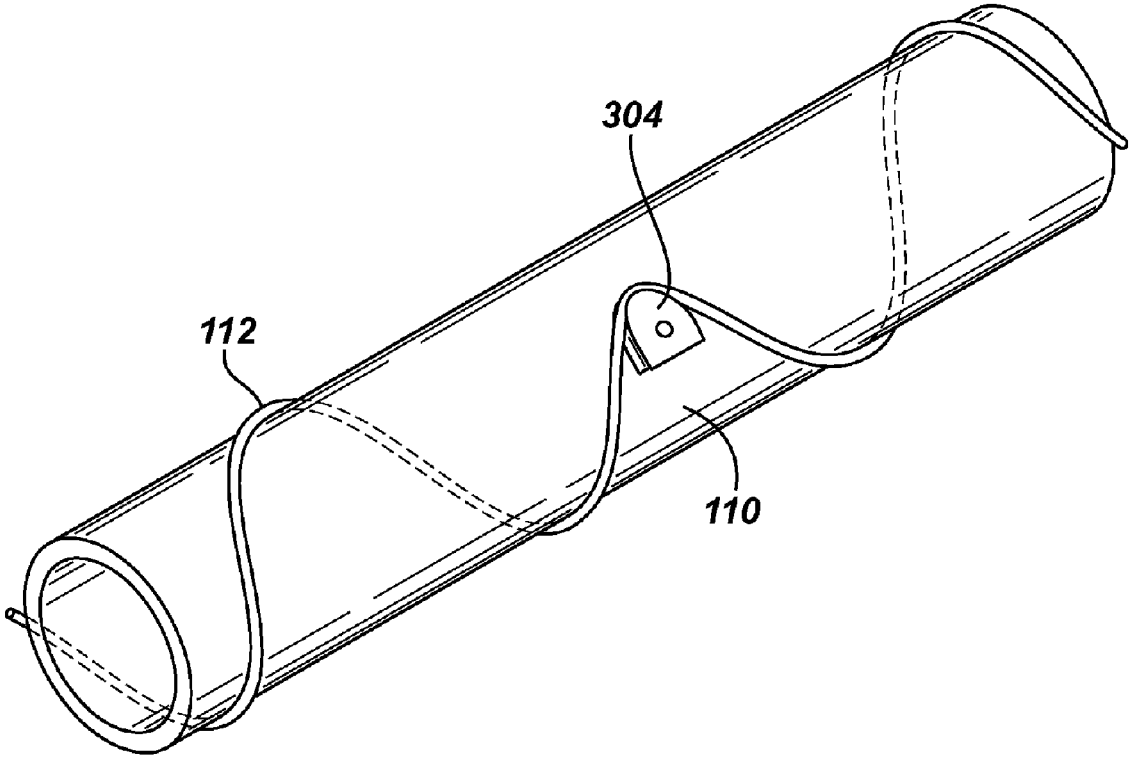
FIG. 6A is a schematic view of a line slack compensator constructed in accordance with the present invention.
Figure 6B:
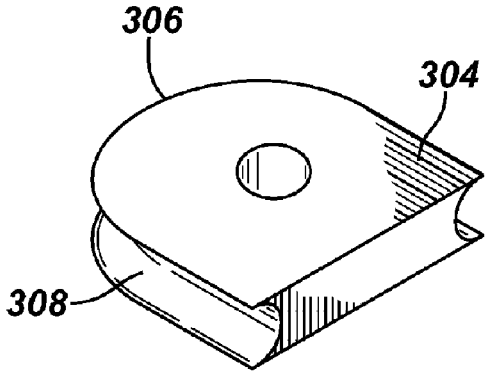
FIG. 6B is a schematic view of a component of the line slack compensator of FIG. 6A.

Similarly, in FIG. 6A a catch 304 is shown releasably mounted on mandrel 110. Catch 304 preferably has a curved nose 306 with a channel 308 to carry control line 112 without inducing undue bending stress in control line 112. FIG. 6B shows an enlarged view of catch 304.

Figure 7A:
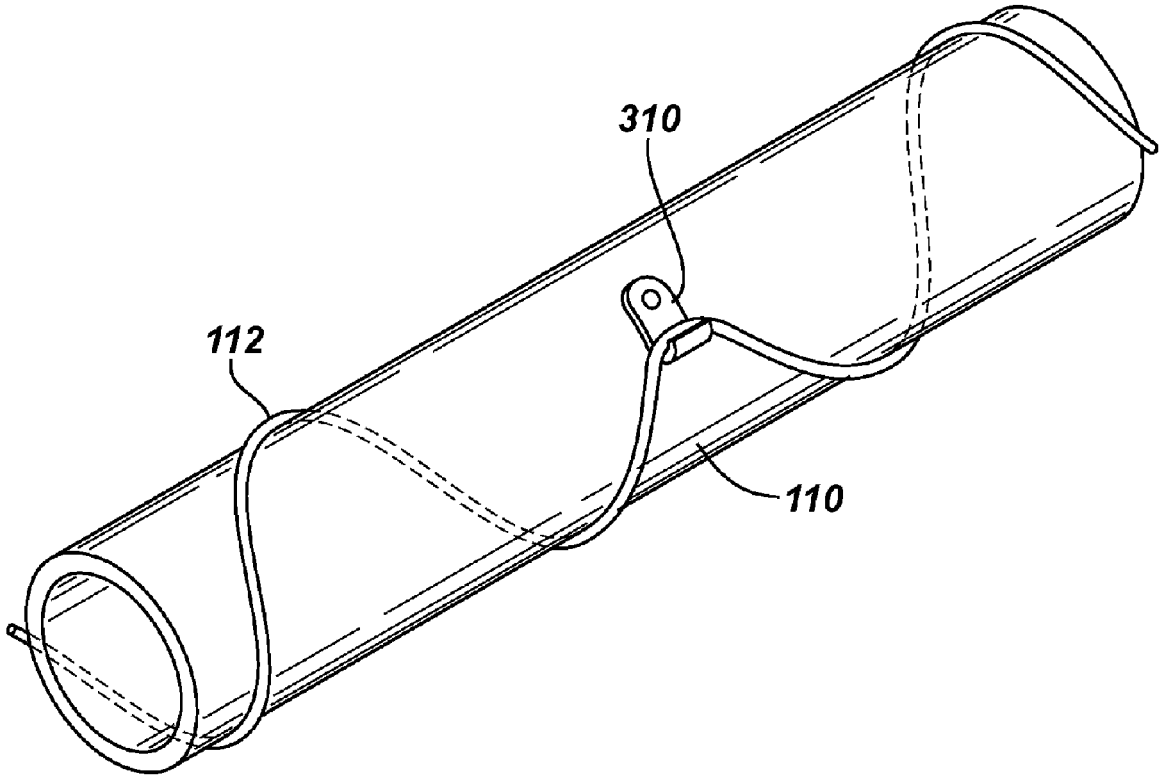
FIG. 7A is a schematic view of a line slack compensator constructed in accordance with the present invention.
Figure 7B:
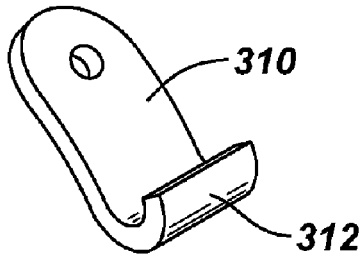
FIG. 7B is a schematic view of a component of the line slack compensator of FIG. 7A.

FIG. 7A shows yet another embodiment of line compensator 10 in which a hook 310 is used to capture control line 112 and remove slack therefrom. Hook 310 is removably mounted on mandrel 110 and has a curved end 312 to snare control line 112. FIG. 7B shows an enlarged view of hook 310.

Figure 8:
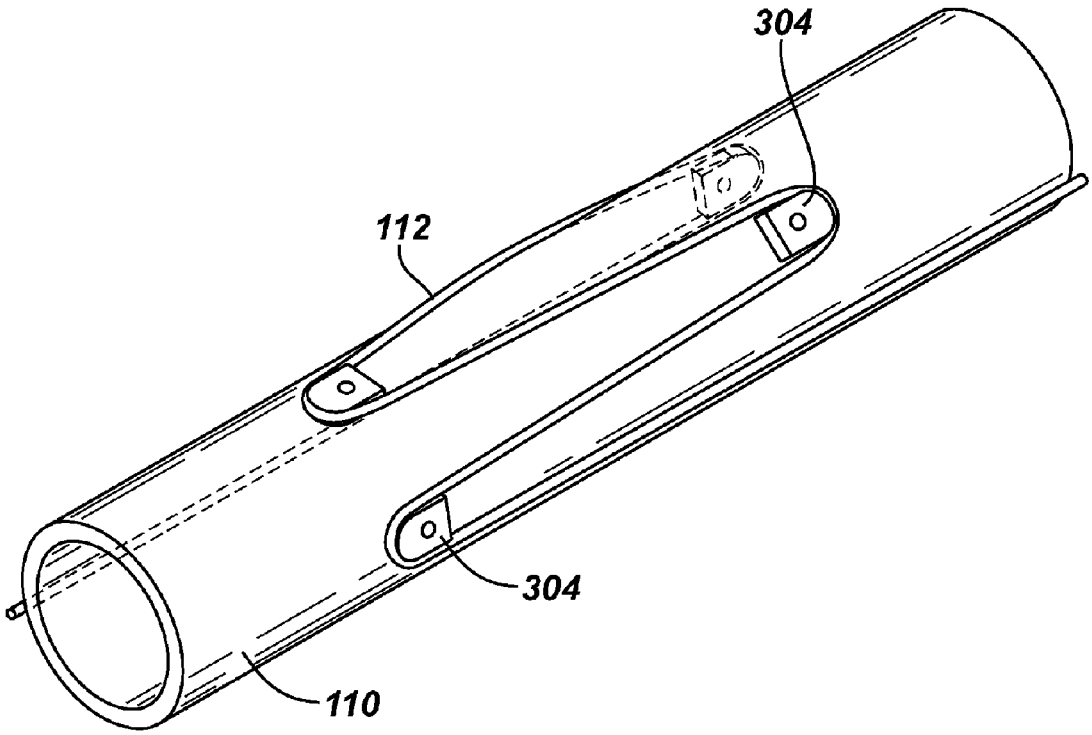
FIG. 8 is a schematic view of a line slack compensator constructed in accordance with the present invention.
Figure 9:
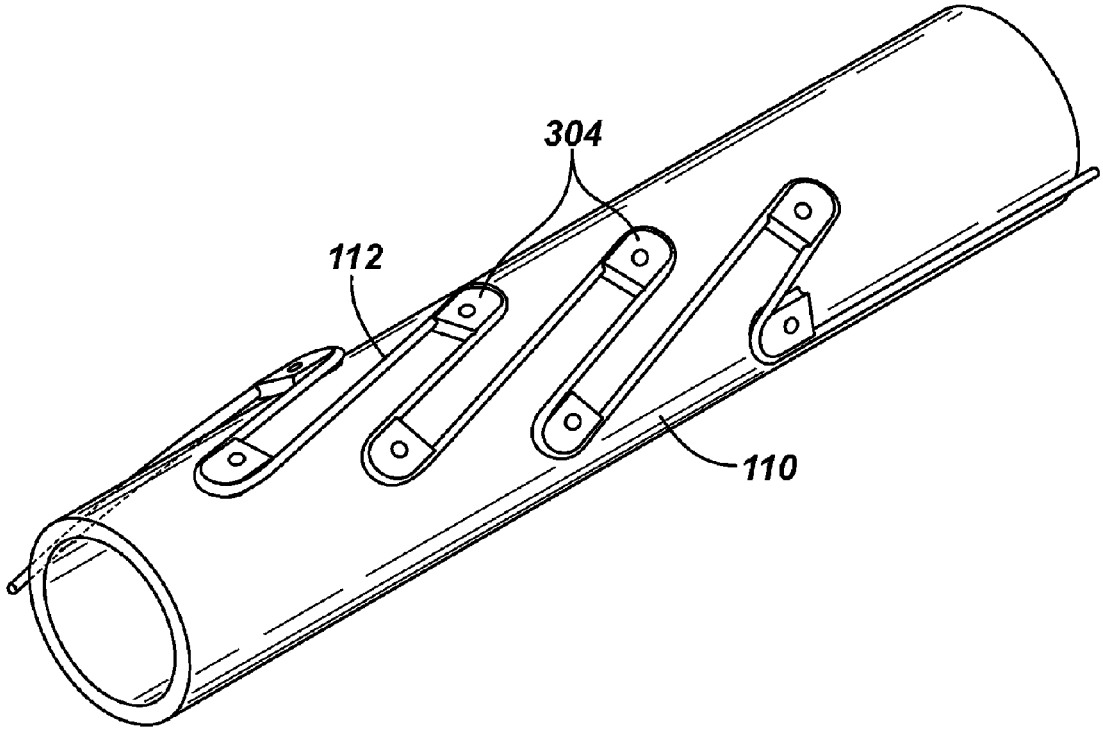
FIG. 9 is a schematic view of a line slack compensator constructed in accordance with the present invention.

In FIG. 8, an alternate arrangement of catches 304 is shown. In this embodiment, catches 304 are longitudinally and radially misaligned or offset. Control line 112 is laced or woven around catches 304 to remove slack therefrom. FIG. 9 shows a similar arrangement in which catches 304 are longitudinally staggered around the circumference of mandrel 110. Control line 112 is again interlaced or interwoven around catches 304 to take up or remove slack therefrom. Many other variations are possible and within the scope of this invention.

Figure 4:
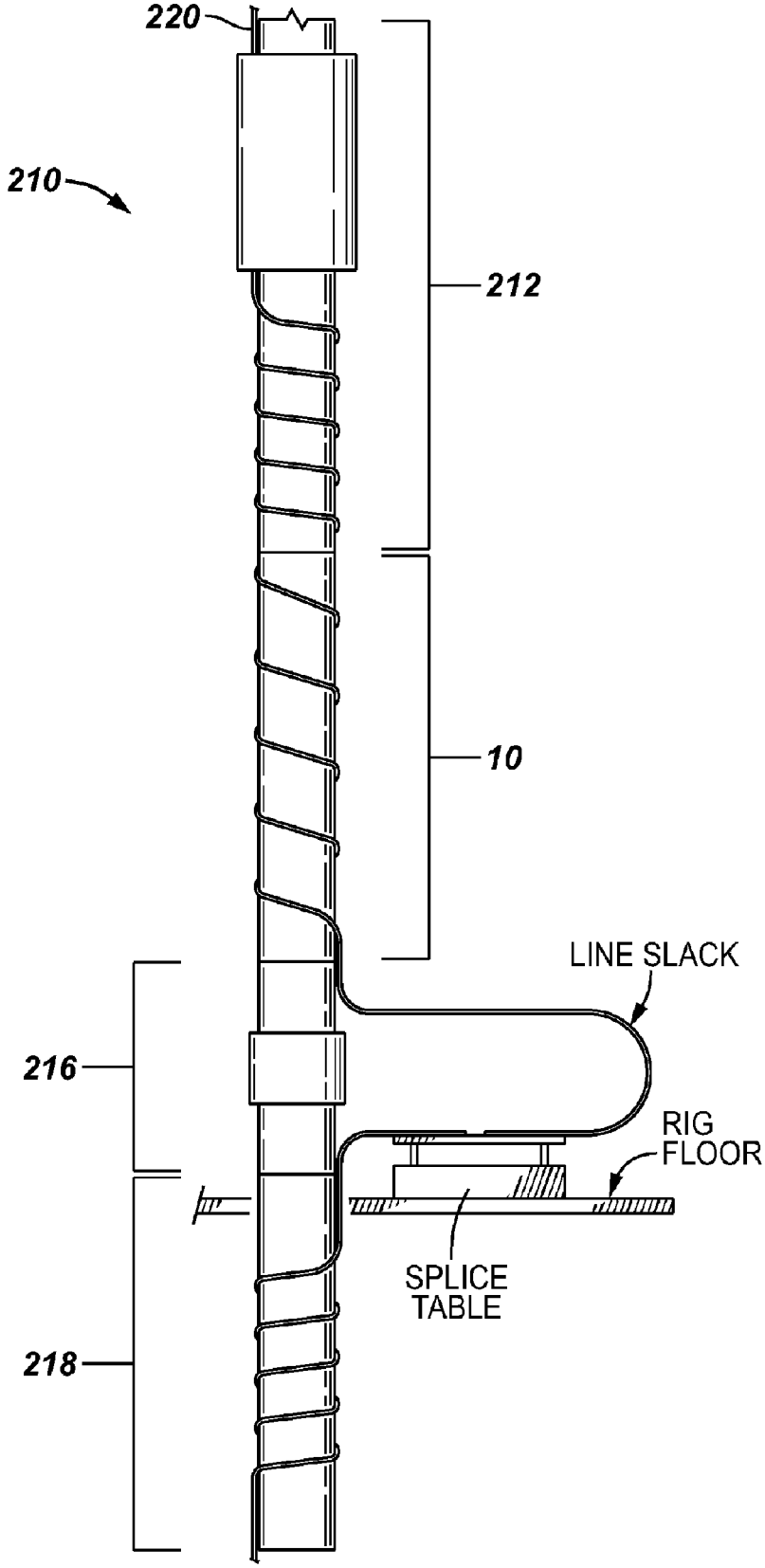
FIG. 4 is a schematic view of a completion assembly incorporating a line slack compensator constructed in accordance with the present invention.

Referring to FIG. 4, line slack compensator 10 can be incorporated into a completion assembly 210 comprising a contraction joint 212, a line slack compensator 10, a make-up sub 216, and a stinger 218. In the embodiment shown, a fiber optic cable 220, having at least one splice, extends from the surface to stinger 218.

When assembled and ready to be run into the well, contraction joint 212 is joined to line slack compensator 10, line slack compensator 10 is joined to make-up sub 216, and make-up sub 216 is joined to stinger 218.

An assembly method includes joining stinger 218 and make-up sub 216 and placing that combination in the rotary. In the embodiment shown, a lower free end of fiber optic cable 220 extends from the stinger/make-up sub combination. Contraction joint 212 and line slack compensator 10 are joined and that combination is stabbed or otherwise joined to the stinger/make-up sub combination, preferably without rotation of either combination. An upper free end of fiber optic cable 220 extends from the contraction joint/line slack compensator combination.

The upper and lower free ends of fiber optic cable 220 must be spliced together before assembly 210 can be run into the well. If slack is need, it may be obtained from line slack compensator 10. Once the splice is made, slack is removed by line slack compensator 10. If desired, a splice of fiber optic cable 220 can also be made between contraction joint 212 and line slack compensator 10. Line slack compensator 10 can provide or remove slack at its upper and lower ends.

Line slack compensator 10 is able to provide or remove slack by extension or contraction of various turns of fiber optic cable 220 wrapped around a mandrel 18 in line slack compensator 10. Movement of those loosely wrapped coils allows extension or contraction similar to that of a coil spring.

Make-up sub 216 is a tool well known in the art, and is sometimes referred to as a "quick connect" or "make-up union". It comprises upper and lower halves with a clutch interface to transmit torque when the two halves are joined. The two halves are stabbed together and the collar (and only the collar) is rotated to secure the two halves together.

Although only a few exemplary embodiments of this invention have been described in detail above, those skilled in the art will readily appreciate that many modifications are possible in the exemplary embodiments without materially departing from the novel teachings and advantages of this invention.

What is claimed is:

1. A completion assembly comprising:

an upper assembly;

a control line; and a line slack compensator connected to the upper assembly, in which the control line is a hydraulic conduit, an electrical line, or a fiber optic cable.

2. The completion assembly of claim 1 further comprising a make-up sub connected to the line slack compensator.

3. The completion assembly of claim 2 further comprising a lower assembly connected to the make-up sub.

4. The completion assembly of claim 3 in which the lower assembly comprises a stinger.

5. The completion assembly of claim 1 in which the line slack compensator provides or removes slack in the control line.

6. The completion assembly of claim 1 in which the line slack compensator further comprises:

a mandrel; and a sleeve carried and axially moveable on the mandrel and having a slot to engage a coiled portion of the control line.

7. The completion assembly of claim 6 further comprising a protective sleeve at least partially enclosing the coiled portion of the control line.

8. The completion assembly of claim 1 in which the upper assembly comprises a contraction joint.

9. A method to run a completion assembly having a control line in a well comprising:

holding a lower portion of the completion assembly having a lower free end of the control line extending therefrom;

joining an upper portion of the completion assembly having an upper free end of the control line extending therefrom to the lower portion of the completion assembly;

obtaining slack in the control line, if needed, from a line slack compensator incorporated into the completion assembly;

splicing the control line upper and lower free ends;

removing slack in the control line, if needed; and lowering the completion assembly having the control line into the well.

10. The method of claim 9 in which the upper and lower portions of the completion assembly are joined without rotation of either portion.

11. A line slack compensator comprising:

a mandrel;

a sleeve moveably carried on the mandrel and adapted to receive one or more coils of a control line.

12. The line slack compensator of claim 11 further comprising a protective sleeve at least partially enclosing the coils of the control line.

13. The line slack compensator of claim 11 further comprising a fastener to releasably secure the sleeve to the mandrel.

14. The line slack compensator of claim 11 in which the sleeve has slots to hold the control line.

15. A line slack compensator comprising:

a mandrel;

at least one ring rotatably carried on the mandrel and adapted to receive a control line, in which the at least one ring comprises an upper ring, a middle ring, and a lower ring.

16. The line slack compensator of claim 15 in which the at least one ring has a sidewall having at least one hole axially therethrough to receive the control line.

17. The line slack compensator of claim 16 in which the at least one hole has curvature.

18. The line slack compensator of claim 15 in which the at least one ring has a sidewall having at least one hole radially therethrough and adapted to receive a fastener to secure the ring to the mandrel.

19. The line slack compensator of claim 15 in which each ring has a sidewall having a hole axially therethrough to receive a control line.

20. The line slack compensator of claim 19 in which each hole has curvature.

21. The line slack compensator of claim 15 in which the upper and lower rings are secured to the mandrel and the middle ring is rotatably carried on the mandrel.

22. The line slack compensator of claim 15 in which the upper and lower rings are rotated one direction and the middle ring is rotated in the opposite direction.

23. The line slack compensator of claim 15 in which the at least one ring has a sidewall having at least one groove therein to receive the control line.

24. The line slack compensator of claim 23 in which the at least one groove has curvature.

25. A line slack compensator comprising:

a mandrel;

a plurality of fasteners removeably mounted on the mandrel and adapted to receive a control line, in which fasteners of the plurality of fasteners are longitudinally and radially offset from each other.

26. The line slack compensator of claim 25 in which fasteners of the plurality of fasteners are longitudinally offset and circumferentially staggered around the mandrel.

27. The line slack compensator of claim 25 in which at least one fastener of the plurality of fasteners is a catch or hook.

28. A method to provide or remove slack in a control line comprising:

providing a mandrel, an upper ring, a middle ring, and a lower ring, each ring being carried on the mandrel and comprising a sidewall having a hole axially therethrough with the control line passing through each hole, the holes in the upper and lower rings being substantially aligned and the upper and lower rings secured to the mandrel;

rotating the middle ring to align the holes to provide slack in the control line, and rotating the middle ring to misalign the holes to remove slack in the control line.

* * * * *